US005665042A

United States Patent [19]

Breaux

[11] Patent Number: 5,665,042

[45] Date of Patent: Sep. 9, 1997

[54] EXERCISER

[76] Inventor: Lawrence Wayne Breaux, 30523 N. Deed Ave., Castaic, Calif. 91384

[21] Appl. No.: 642,903

[22] Filed: May 6, 1996

[51] Int. Cl.[6] ..... A63B 23/02

[52] U.S. Cl. ..... 482/142

[58] Field of Search ..... 482/142, 121, 482/122, 129, 130, 140, 907, 145

[56] References Cited

U.S. PATENT DOCUMENTS

| | | | |
|---|---|---|---|
| Re. 24,762 | 1/1960 | Sellner | 155/45 |
| Re. 26,725 | 11/1969 | Sellner | 128/57 |
| 3,005,358 | 10/1961 | Riemer | 482/142 |
| 3,043,591 | 7/1962 | Sellner | 482/142 |
| 3,075,518 | 1/1963 | Sellner | 482/142 |
| 3,315,666 | 4/1967 | Sellner | 482/142 X |
| 3,378,259 | 4/1968 | Kupchinski | 482/142 |
| 3,561,772 | 2/1971 | Curtess | 482/142 |
| 3,596,906 | 8/1971 | Parmer | 482/142 |
| 3,716,230 | 2/1973 | Mark | 482/142 |
| 3,761,081 | 9/1973 | Simmons | 482/142 |
| 3,782,717 | 1/1974 | Berlin | 482/142 |
| 5,215,511 | 6/1993 | Cheng | 482/121 |
| 5,474,513 | 12/1995 | Calesimo et al. | 482/140 |

*Primary Examiner*—Richard J. Apley
*Assistant Examiner*—William LaMarca
*Attorney, Agent, or Firm*—Christie, Parker & Hale, LLP

[57] ABSTRACT

Exercise apparatus includes first and second elongated and substantially rigid beds disposed end-to-end, and mounted on a support so the beds can pivot with respect to each other about a substantially horizontal central axis between adjacent ends of the beds.

26 Claims, 8 Drawing Sheets

EXERCISER

FIELD OF THE INVENTION

This invention relates to portable exercise apparatus. More specifically, this invention provides improvements to previous exercise apparatus, such as that shown in U.S. Pat. No. Re. 24,762, reissued Jan. 5, 1960 to Sellner; U.S. Pat. No. Re. 26,725, reissued Nov. 25, 1969 to Sellner; and U.S. Pat. No. 3,596,906, issued Aug. 3, 1971 to Parmer.

The previous exercise devices of this type use canvas or other flexible covering stretched over a frame to support a user of the exercise apparatus. Such devices did not provide adequate body support for optimum benefit from exercising, and were also not adjustable to accommodate users of different heights.

This invention provides an exerciser in which the user is supported on two relatively rigid beds which pivot with respect to each other and provide improved exercise function. Moreover, the apparatus of this invention is adjustable for users of different heights.

In brief, the exercise apparatus of this invention includes first and second elongated and substantially rigid beds disposed so an end of one of the beds is adjacent an end of the other bed. Means are provided for supporting the beds so they can pivot with respect to each other about a substantially horizontal central axis between adjacent ends of the beds. Preferably, each bed includes a stiff base member covered by padding to provide increased comfort to the user. A separate U-shaped frame is disposed around and spaced from each bed with the open ends of the frames adjacent each other and connected so the frames can pivot with respect to each other about the central axis. Each bed is connected to a respective frame, and the frames are pivotally connected to a support, which rests on a floor or other suitable surface.

Preferably, at least one of the U-shaped frames includes a telescoping connection at the closed end of the frame so the length of the frame can be adjusted to accommodate users of different heights. Moreover, the outer end of at least one of the frames slopes upwardly and outwardly away from the center of the exerciser so a user can comfortably lock his feet under that end of the frame to facilitate performing various kinds of exercises. The outer end of at least one of the beds includes recesses which open upwardly and outwardly from the center of the exerciser to provide a comfortable resting position for the ankles of the user. Means are also provided for releasably locking the beds in a substantially flat plane to provide a platform for situps, pushups, and other types of exercise.

These and other aspects of the invention will be more fully understood from the following detailed description and the accompanying drawings in which:

DETAILED DESCRIPTION

Figure 1:
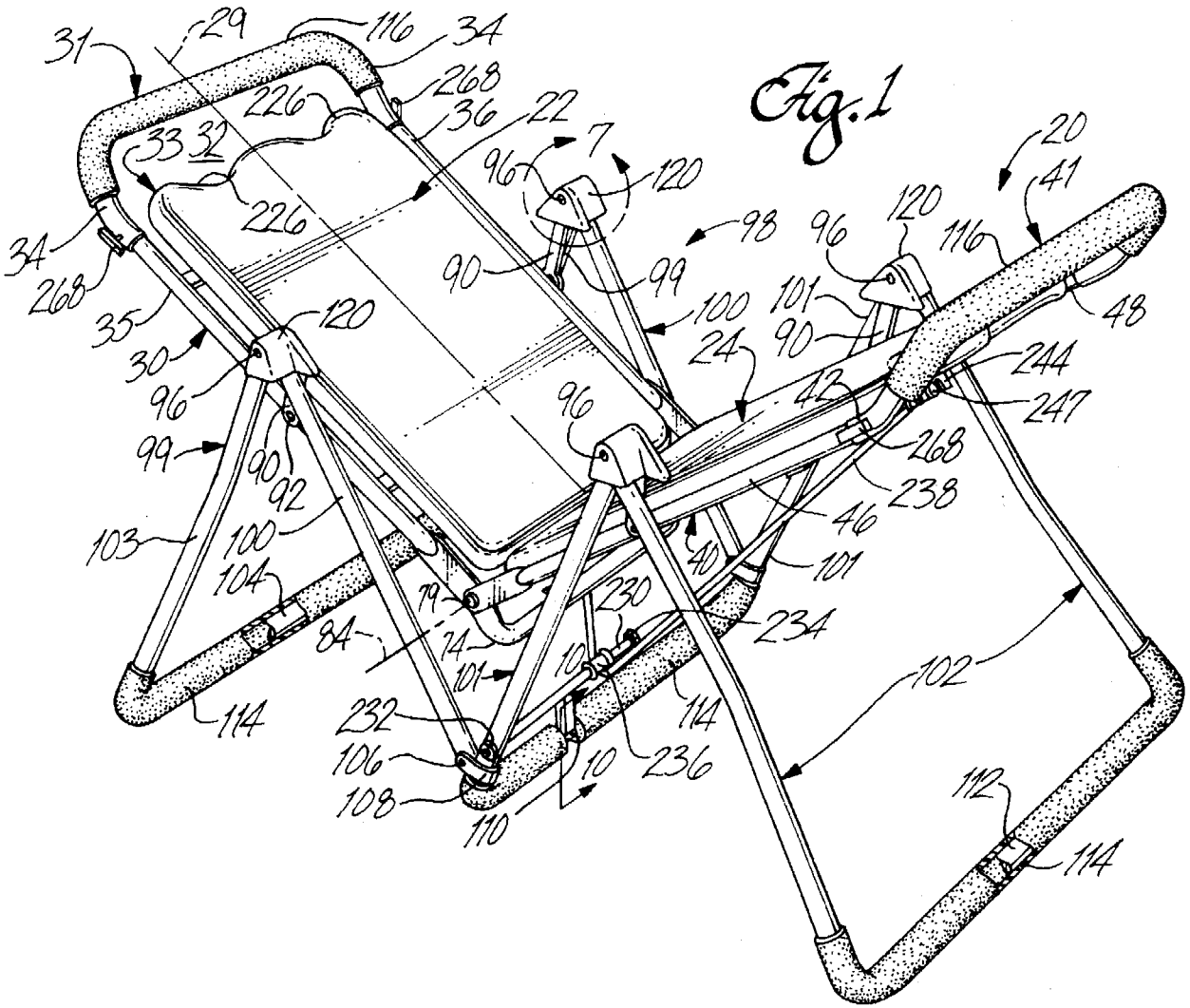
FIG. 1 is a perspective view of the presently preferred embodiment of the invention.
Figure 2:
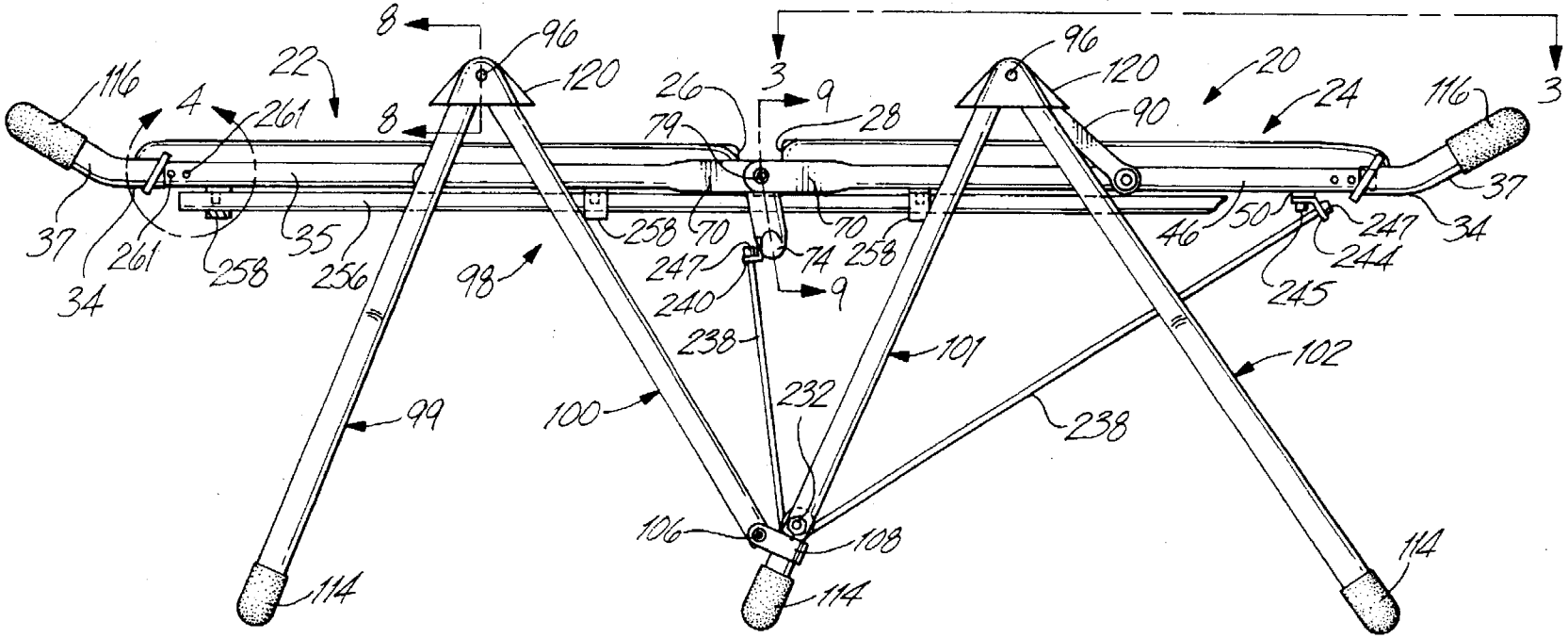
FIG. 2 is a side elevation of the apparatus with the two beds locked in a horizontal plane with a single locking bar.

Referring to FIGS. 1 and 2, an exerciser 20 includes first and second identical flat, rectangular and rigid beds 22 and 24, respectively. The beds are disposed with respect to each other so that an inner end 26 of the first bed is adjacent and parallel to an inner end 28 of the second bed so the respective longitudinal centerline axes of the two beds lie in a common vertical plane which contains a longitudinal centerline 29 (FIG. 1) of the exerciser.

A first U-shaped frame 30 is disposed around the distal end 33 of the first rigid bed to lie in substantially the same major plane of that bed.

An elongated transverse base 31 at the closed end 32 of the first U-shaped frame is adjacent and spaced from the distal end 33 of the first rigid bed. The base includes a separate arm 34 formed integrally with the base at each end of the base. Each arm is collinear with, and makes a close sliding or telescoping fit over a respective outer end of each of a pair of frame side legs 35 and 36 of the first U-shaped frame. To this end, the base 31, arms 34, and side legs 35 and 36 are each made of tubular steel, with the O.D. of the frame legs being slightly less than the I.D. of the base arms 34.

As shown in best in FIG. 2, each arm 34 includes a bent portion 37 which extends upwardly and away from the center of the exerciser so that the transverse base 31 lies in a plane parallel to, but substantially above, the top surface of the first bed 22.

A second U-shaped frame 40, identical with the first U-shaped frame, is disposed around the second rigid bed, as just described with respect to the first rigid bed and first U-shaped frame. The second U-shaped frame includes an elongated transverse base 41 and arms 42 which make a sliding or telescopic fit over the outer ends of second frame legs 46 and 48.

Figure 3:
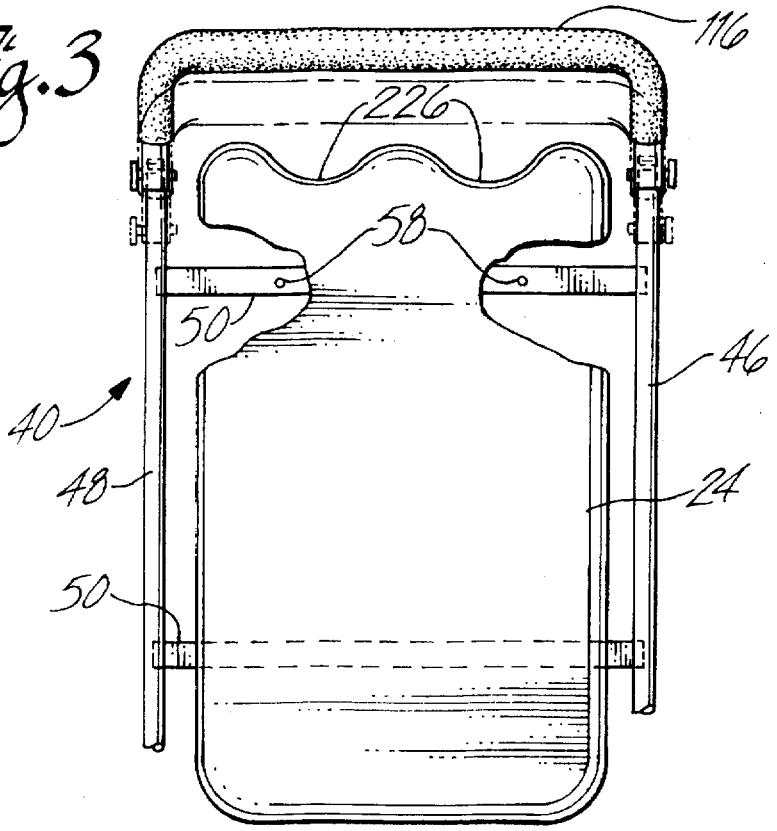
FIG. 3 is a fragmentary view of one bed frame taken along line 3—3 of FIG. 2 and partly broken away.
Figure 4:
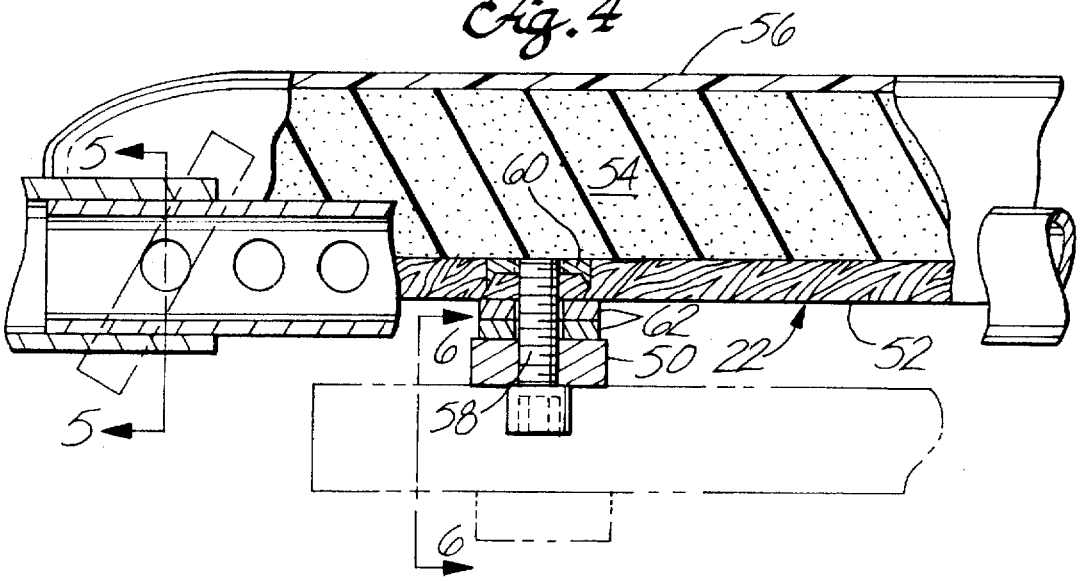
FIG. 4 is an enlarged sectional view taken in the vicinity of the arrows 4 in FIG. 2.

Each rigid bed rests on a respective pair of transverse beams 50 (FIGS. 1, 2, and 3), each welded at their respective ends at longitudinally spaced locations to the undersides of respective frame legs. As shown best in FIG. 4, the second rigid bed 22 includes a bottom board 52, which may be plywood or other suitable stiff material. A layer of polyurethane foam 54 on the top surface of the board 52 is held in place by a cover 56 secured by suitable means, such as staples (not shown), adhesive, or the like, to the board. A pair of laterally spaced bolts 58 each extend up through a respective beam 50, and are each threaded into a respective nut 60 embedded in the top surface of the rigid board 52. Suitable washers 62 around each bolt and between the top surface of the beam and the bottom surface of the board permit a tight connection without damaging the board. The fragmentary plan view of FIG. 3 shows where a pair of bolts 58 extend through each beam 50 to secure the second bed to the second frame. The first bed is constructed as Just described for the second bed and is secured to the second U-shaped frame in the same manner.

Figure 9:
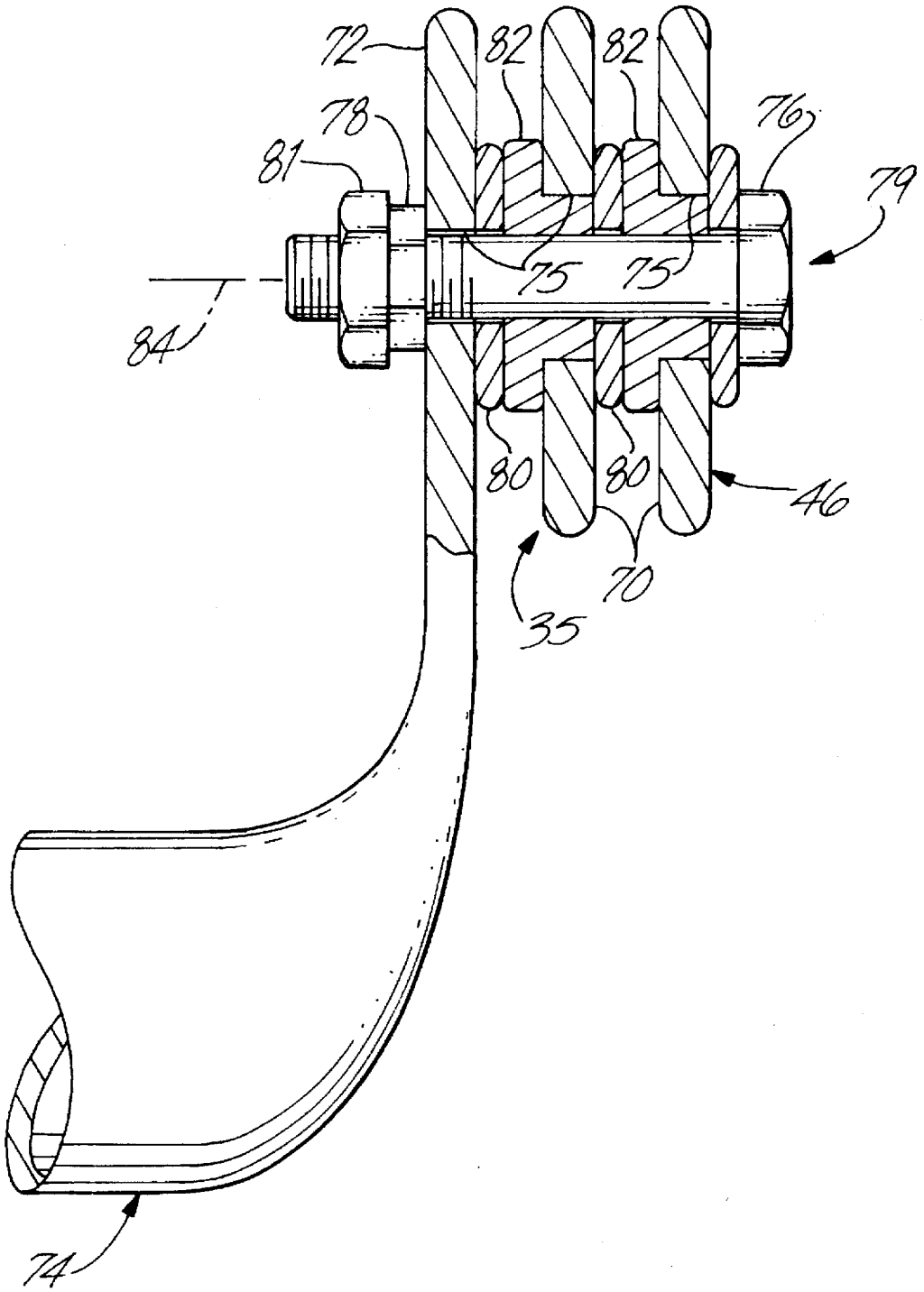
FIG. 9 is a view taken along line 9—9 of FIG. 2.

The U-shaped frames are preferably formed of tubular steel, and the inner end of each of the first and second frame legs 35, 36, 46, and 48 include a relatively short flattened section 70. As shown in FIG. 9, the flattened sections 70 on the legs 35 and 46 overlap with a similarly flattened section 72 of an upwardly opening U-shaped brace 74. The flattened sections 70 and 72 of the U-shaped brace have collinear bores 75, and are secured together by a bolt 76 and nut 78 to form a frame central pivot joint 79. Washers 80, located as shown in FIG. 9, facilitate the pivot action of pivot joint 79. A lock nut 81 holds the pivot joint 79 together without binding. A separate sealed ball bearing 82 is journaled on the bolt 76 and in a respective bore 75 of a flattened section 70 of legs 35 and 46. A similar pivot joint (not shown) is formed at the other end of the U-shaped brace 74 so the first and second beds and the adjacent ends of the first and second U-shaped frames can pivot about a common central axis 84 (FIGS. 1 and 9), which is collinear with the longitudinal axis of the bolt 76 in pivot joint 79.

Figure 7:
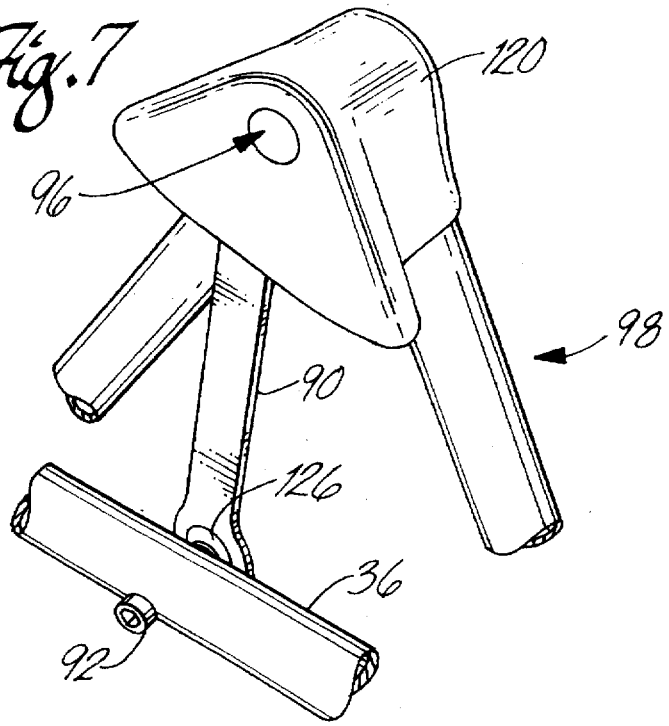
FIG. 7 is an enlarged fragmentary perspective view of a pivot joint taken in the vicinity indicated by the arrows 7 in FIG. 1.
Figure 8:
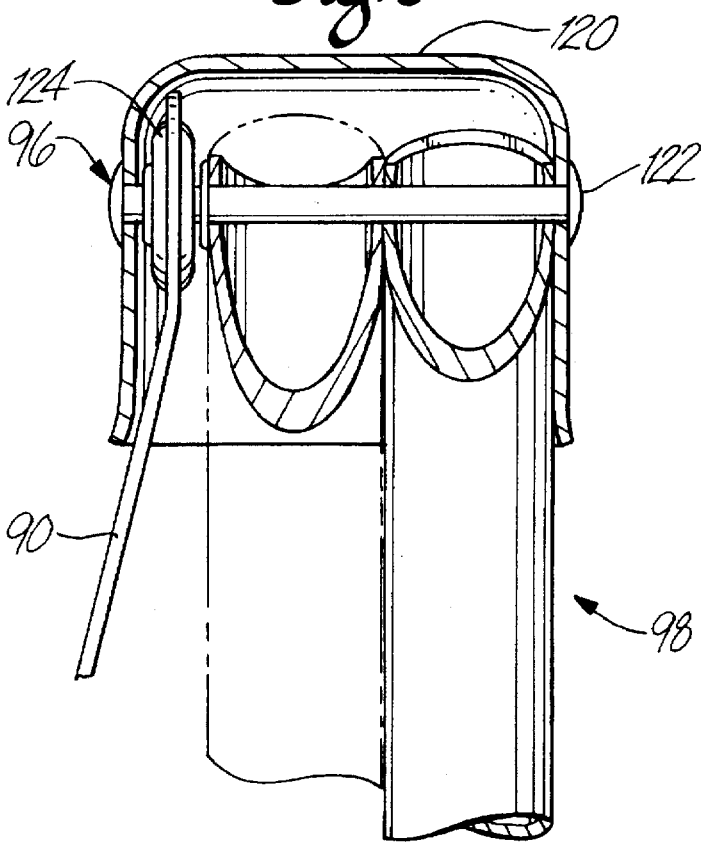
FIG. 8 is a fragmentary vertical and transverse sectional view taken of the pivot joint shown in FIG. 7.

As shown in FIGS. 1 and 7, a separate elongated, support link 90 is secured at its lower end by a respective lower pivot Joint 92 to the outside and midpoint of a respective frame leg. The upper end of each support link is connected, as shown in detail in FIG. 8, by an upper pivot joint 96 on a support 98.

As shown in FIGS. 1 and 2, the support includes first, second, third, and fourth pairs of inclined support legs 99, 100, 101, and 102, respectively. The legs in each pair are on opposite sides of the exerciser and lie in a common plane which is perpendicular to the longitudinal axis of the exerciser. The legs in the first pair 99 lie in a plane which extends downwardly and to the left, as viewed in FIGS. 1 and 2.

As shown in FIGS. 1 and 2, the first pair 99 of support legs (on opposite sides of the exerciser) each extend down from a respective pivot joint 96. The upper portions of each leg in the first pair are parallel with each other, and lower portions 103 of each leg of the first pair of support legs extend outwardly away from each other in the common plane defined by the two first support legs. The lower end of each leg in the first pair is curved inwardly and formed integrally with a respective end of transverse support bar 104, which rests on a floor (not shown) or other suitable surface for the exerciser.

A respective support leg in the second pair 100 extends downwardly and to the right (as viewed in FIGS. 1 and 2) from a respective upper pivot joint 96 as a respective support leg in the first pair. A respective lower end of a support leg in each second pair 100 is secured to a respective lower pivot joint 106 extending through a respective clamp 108, which secures a respective lower end of a support leg in the second pair to the lower end of a respective support leg in the third pair 101.

The support legs in the third pair 101 are parallel and lie in a common plane perpendicular to the longitudinal axis of the exerciser, and which is inclined upwardly to the right, as viewed in FIGS. 1 and 2. The lower end of each support leg in the third pair is curved inwardly and formed integrally with a horizontal transverse support bar 110, which rests on the floor.

The upper respective ends of the support legs of the third and fourth support pairs are each secured to a respective upper pivot joint 96 on opposite sides of the exerciser. The support legs in the fourth pair 102 are parallel to each other and lie in a common inclined plane which is perpendicular to the longitudinal axis of the exerciser and extends downwardly and to the right (as viewed in FIGS. 1 and 2). The lower portions of each leg in the fourth pair diverge outwardly away from each other, and the lower ends of each fourth support leg are curved inwardly and formed integrally with a horizontal transverse support bar 112, which rests on the floor.

The lower portions of the support legs in the first, third, and fourth pairs and their respective transverse support bars are each covered with a sleeve 114 of nonslip elastomer, such as butyl rubber, or the like. The transverse bases 31 and 41 at the left and right ends (as viewed in FIGS. 1 and 2), respectively, of the frames around the beds of the exerciser are also covered with a sleeve 116 of nonslip elastomer.

As shown in FIGS. 1, 2, 7, and 8, a separate respective protective cap 120 covers each upper pivot joint 96, and is held in place by a respective bolt 122 extending through the upper pivot joint and collinear bores through each cap and the upper respective ends of support legs and the support link under each cap. A separate roller bearing 124 on and adjacent the inner end of each bolt 122 supports the upper end of a respective support link. The lower end of each support link 90 is connected to its respective lower pivot joint 92 by a respective roller bearing 126 (FIG. 7).

All the pivot joints described above are constructed to permit the respective elements secured to them to pivot about respective substantially horizontal axes substantially perpendicular to a common vertical plane passing through the longitudinal axis of the exerciser.

The outer ends of each rigid bed are provided with recesses 226, which open upwardly and longitudinally outwardly to provide comfortable recesses for the arms or legs of the user of the exerciser.

Figure 10:
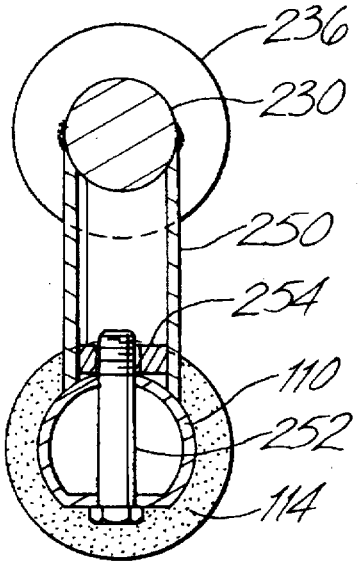
FIG. 10 is a view taken along 10—10 of FIG. 1.

Referring to FIGS. 1, 2, and 10, a horizontal and transverse pulley rod 230 under the exerciser extends through and is secured adjacent the lower end of one of the third support legs 101 by a lock nut 232. The inner end of the rod 230 carries a stop nut 234 which limits the longitudinal travel of a pulley 236 mounted on the rod to rotate about a horizontal axis perpendicular to a vertical plane passing through the longitudinal axis of the exerciser. An elastic cord 238 extends under and around the lower half of the pulley. One end of the elastic cord is held by a first anchor plate 240 (FIG. 2) secured to the center portion of the U-shaped brace 74. The other end of the elastic cord is held under tension by a second anchor plate 244 mounted by a bolt 245 on the outermost beam 50 which supports the outer end of the second bed. Each anchor plate includes transversely spaced and outwardly opening slots 246 (shown only in FIG. 1) which receive the adjacent portion of a respective end of the elastic cord. Each end of the elastic cord is knotted to provide a stop 247 so the cord cannot be pulled by tension inwardly through the slot in which it is mounted. Although not shown, a number of additional elastic cords can be mounted to the anchor plate and around the pulley to provide various amounts of tension as the exerciser is used. Moreover, the cord can be knotted at different points to vary the amount of tension applied by the cord.

As shown best in FIG. 10, the upper end of a hollow vertical pillar 250 is welded to the underside of pulley rod 230. The lower end of the pillar is shaped to make a snug fit on the top portion of the transverse base 110. A bolt 252 secures the pillar to the base 110.

The two beds of the exerciser can be locked in the horizontal position shown in FIG. 2 when the beds are to be used as an exercise platform, say, for situps or the like. The locked position of FIG. 2 is effected by a longitudinally extending locking bar 256, which makes a snug fit through upwardly facing U-shaped brackets 258 welded to the lower faces of the central portions of the beams 50. When the exerciser is to be used in its normal fashion, the locking bar is removed.

Figure 5:
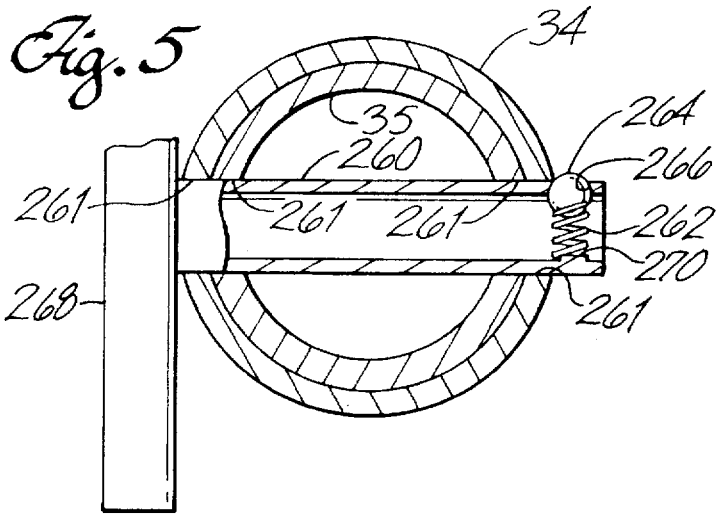
FIG. 5 is a view taken along line 5—5 of FIG. 4.
Figure 6:
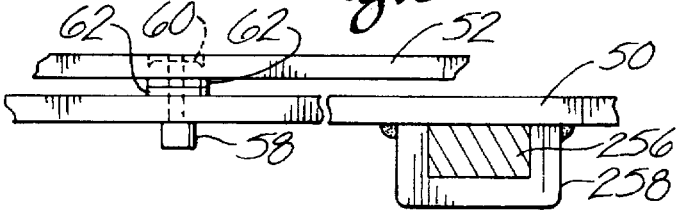
FIG. 6 is a fragmentary view taken along line 6—6 of FIG. 4.

The effective length of the frames which surround the two beds can be adjusted by the telescoping connections at the outer end of each frame. Referring to FIGS. 1, 2, and 5, the telescoping joint for the frame leg 35 and arm 34 includes a tubular horizontal locking pin 260 which extends through collinear bores 261 in the frame leg 35 and arm 34. The leg has a set of longitudinally spaced collinear bores 261. The upper end of a compression spring 262 at the inner end of the locking pin urges a detent ball 264 into undersized opening 266 through the upper portion of the locking pin so that part of a ball projects above the locking pin to prevent it from slipping from the position shown in FIG. 5, unless effective pulling force is applied to a handle 268 on the outer end of the locking pin. The lower end of the compression spring 262 fits around a vertical internal boss 270 on the interior surface of the inner end of the locking pin to hold the spring and ball in the detent position.

The length of a telescoping joint is adjusted by pulling on the handle 268 to overcome the spring action exerted on the detent ball 264, and the pin is withdrawn from the position shown in FIG. 5. The same operation is applied to the corresponding telescoping joint (which is constructed as just described for frame base arm 34 and frame side leg 15) on the opposite side of the exerciser so that end of the frame can be adjusted in length by using the desired set of bores 261 in the legs. If desired, the end of the frame can be completely removed, turned 180° about the longitudinal axis of the exerciser, and reassembled so that the transverse base of the end of the frame is located below the major plane of the bed to which the frame is attached.

Figure 11:
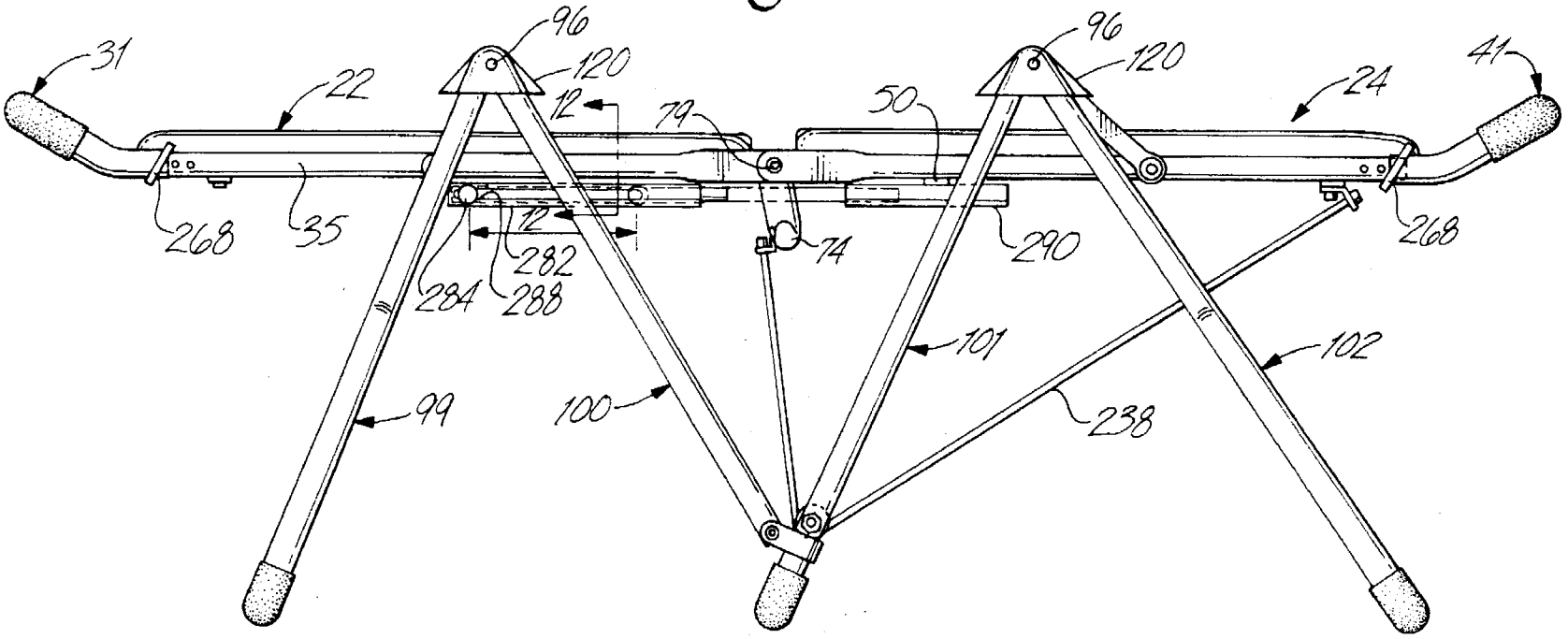
FIG. 11 is a side elevation similar to FIG. 2 showing the two beds locked in a horizontal plane by telescoping tubes.
Figure 12:
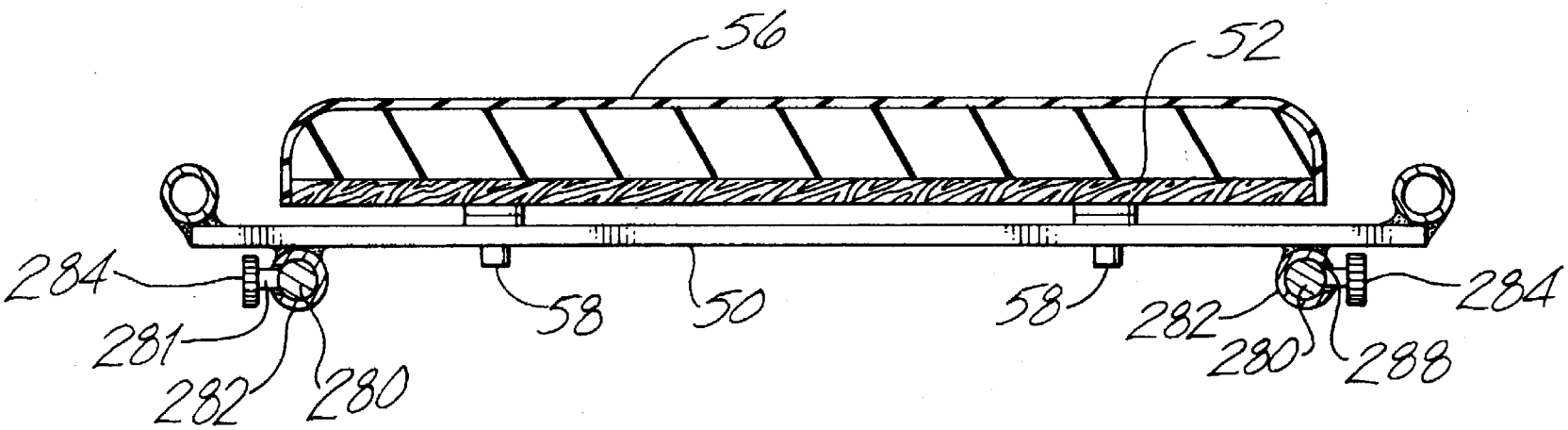
FIG. 12 is a view taken on line 12—12 of FIG. 11.

An alternative arrangement for locking the beds in the horizontal position shown in FIG. 2 is shown in FIGS. 11 and 12. A longitudinally extending locking rod 280 is mounted to make a close sliding fit in a tubular bracket 282 welded to the lower face of the innermost transverse beam 50, and adjacent one edge of the first bed. The locking rod is moved longitudinally in the tubular bracket 282 by a handle 284 secured to the outer end of a horizontal and transverse shaft 286 threaded into the locking rod 280. The shaft 286 extends through a longitudinal and outwardly opening slot 288 in the wall of the tubular bracket 282.

When the handle 284 and locking rod 280 are moved longitudinally and inwardly from the unlocked position shown in FIG. 11 to the phantom line position shown in FIG. 11, the right (as viewed in FIG. 11) end of the rod enters a receiving tube 290 welded to the lower face of the innermost transverse beam 50 for the second bed to be collinear with the tubular bracket 282. Thus, in the phantom line position shown in FIG. 11, the beds are locked in a horizontal plane. As shown in FIG. 12, an identical locking arrangement is mounted on the opposite side of the exerciser, but is not described in detail.

With the exerciser unlocked from the beds being held in a horizontal plane, a user can lie either face up or face down, and force the exerciser to pivot from the V-shaped position shown in FIG. 1 to an inverted V (not shown). The elastic cord can be used or not, as desired, to provide additional resistance to movement of the exerciser, and a more uniform resistance as the exerciser is pivoted about the central axis. The cord can be replaced by any suitable spring means, including a tension spring which can be adjusted by the use of suitable brackets and screws. The elastic band could also be replaced with a crank-and-spring arrangement, or with shock absorbers, or steel springs between the beds.

When the exerciser is not in use, it can easily be folded to a collapsed position with the two beds adjacent each other in substantially vertical planes, and with each of the legs folded up so that they also lie in vertical planes adjacent the folded-up beds.

With the exerciser just described, a user can safely and comfortably use it without being pinched by the adjacent edges of the rigid beds, and still get the added benefit of exercising on a firm, but movable, surface.

In addition, hand grip knobs can be mounted on each side of the pivot at the central axis to make it possible to lock the beds in any attitude with respect to each other, including the horizontal position shown in FIG. 2. An electric counting meter or meters can also be mounted on the exerciser to indicate the pace at which it is being used, and approximate the calories burned, as well as time spent on the exerciser.

The large caps 120 covering the pivot joints 96 minimize the possibility of cutting or pinching during use of the exerciser. The flared-out support legs at each end of the exerciser add stability. The raised ends of the bed frames make it possible for the user to comfortably hook legs or arms under the ends of the frame for various exercises. The recessed ankle and arm rests at each end of the bed provide for more user comfort.

All pivot joints are preferably provided with conventional grease-sealed ball bearing movements for smooth and trouble-free operation of the exerciser.

I claim:

1. Exercise apparatus for supporting a user, the apparatus comprising:

first and second elongated and substantially rigid beds disposed so an end of one of the beds is adjacent an end of the other bed, each bed defining a respective major plane;

a support for the beds; and means for securing the beds to the support so each bed can pivot about a separate respective support axis with respect to the support and so the beds can pivot with respect to each other about a substantially horizontal central axis between adjacent ends of the beds and extending transverse to the beds substantially within the two major planes so the distance between the adjacent ends of the beds remains substantially constant as the beds Pivot.

2. Apparatus according to claim 1 which includes means for releasably locking the two beds in a substantially flat plane.

3. Apparatus according to claim 1 which includes means for locking the two beds in a substantially horizontal plane.

4. Apparatus according to claim 1 in which each bed includes a stiff base member and a layer of padding secured to at least one surface of each base member.

5. Apparatus according to claim 1 which includes two U-shaped frames, each having a pair of substantially parallel and longitudinal legs joined with a respective transverse base to form a respective closed end for each frame, each frame being disposed around respective sides and a distal end of a respective bed with open ends of the frames being adjacent each other so an end of each respective leg in one frame is adjacent an end of a respective leg in the other frame, means securing adjacent ends of legs together to pivot about substantially the same central axis as the beds, means securing each bed to a respective U-shaped frame, a support, and separate links secured to the support and respective legs of the U-shaped frames for pivoting about respective axes spaced from and substantially parallel to the central axis.

6. Apparatus according to claim 5 which includes a U-shaped crossbar with respective ends pivotally secured to the frame legs to pivot about the central axis.

7. Apparatus according to claim 6 which includes a pulley mounted on the support to rotate about an axis substantially parallel to and spaced below the central axis, and an elongated elastic cord secured at one end to the U-shaped crossbar and at the other end to one of the beds at a point spaced from the central axis, the elastic cord being disposed around the pulley on the support.

8. Apparatus according to claim 7 which includes separate anchor means for releasably securing a respective end of the elastic cord to the crossbar and the said one bed.

9. Apparatus according to claim 8 in which each anchor means includes a slot adapted to receive a respective adjacent end of the elastic cord, each end of the elastic cord being enlarged to prevent the cord from sliding longitudinally through the slot when the cord is under tension.

10. Apparatus according to claim 1 in which the means for supporting the beds includes U-shaped sections with upwardly extending support legs, means pivotally connecting the beds to the support legs, each U-shaped section having a respective transverse support bar adapted to rest on a supporting surface, and padding around each support bar where it engages the supporting surface.

11. Apparatus according to claim 5 in which the transverse base of the closed end of one of the U-shaped frames is substantially parallel to and displaced from a plane defined by the two longitudinal frame legs joined with that transverse base.

12. Apparatus according to claim 11 in which the closed end of the said one U-shaped frame telescopes longitudinally with respect to the rest of that frame.

13. Apparatus according to claim 5 in which the closed end of at least one of the U-shaped frames telescopes longitudinally with respect to the rest of that frame so the length of the frame can be adjusted.

14. Apparatus according to claim 13 which includes means for releasably locking the slidable portion of the adjustable frame in different positions.

15. Apparatus according to claim 5 in which each closed end of the U-shaped frames telescopes with respect to the rest of its respective frame, and each frame includes means for locking the telescoping portion of the frame in different positions.

16. Apparatus according to claim 1 in which at least one of the beds includes an end spaced from the central axis and provided with a pair of laterally spaced recesses which are curved in a concave direction upwardly and away from the central axis.

17. Apparatus according to claim 16 in which each bed includes recesses as defined in claim 16.

18. Apparatus according to claim 10 in which the U-shaped sections include portions which extend downwardly and outwardly in a direction transverse to a longitudinal axis of the apparatus.

19. Apparatus according to claim 5 in which the support includes first and second pairs of downwardly extending support legs on each side of the apparatus, the upper ends of the support legs in each pair being connected together by transverse upper pivot pins, a separate downwardly extending link secured at its upper end to a respective pivot pin and at its lower end to a lower pivot pin connected to a respective longitudinal frame leg; and a separate cap disposed over the pivoted connection between the upper ends of a pair of support legs and a respective link.

20. Apparatus according to claim 2 which includes telescoping means mounted on the two beds for locking them in a substantially flat plane.

21. Exercise apparatus comprising:

first and second elongated and substantially rigid beds disposed so an end of one of the beds is adjacent an end of the other bed;

two U-shaped frames, each having a pair of substantially parallel and longitudinal legs joined with a respective transverse base to form a respective closed end for each frame, each frame being disposed around respective sides and a distal end of a respective bed with open ends of the frames being adjacent each other so an end of each respective leg in one frame is adjacent an end of a respective leg in the other frame;

means securing adjacent ends of legs together to pivot about a substantially horizontal central axis between adjacent ends of the beds and extending transverse to the beds;

means securing each bed to a respective U-shaped frame;

a support;

separate links secured to the support and respective legs of the U-shaped frames for pivoting about respective axes spaced from and substantially parallel to the central axis;

a U-shaped crossbar with respective ends pivotally secured to the frame legs to pivot about the central axis;

a pulley mounted on the support to rotate about an axis substantially parallel to and spaced below the central axis; and an elongated elastic cord secured at one end to the U-shaped crossbar and at the other end to one of the beds at a point spaced from the central axis, the elastic cord being disposed around the pulley on the support.

22. Apparatus according to claim 21 which includes separate anchor means for releasably seeming a respective end of the elastic cord to the crossbar and the said one bed.

23. Apparatus according to claim 22 in which each anchor means includes a slot adapted to receive a respective adjacent end of the elastic cord, each end of the elastic cord being enlarged to prevent the cord from sliding longitudinally through the slot when the cord is under tension.

24. Exercise apparatus comprising:

first and second elongated and substantially rigid beds disposed so an end of one of the beds is adjacent an end of the other bed; and means for supporting the beds so they can pivot with respect to each other about a substantially horizontal central axis between adjacent ends of the beds and extending transverse to the beds, at least one of the beds including an end spaced from the central axis and being provided with a pair of laterally spaced recesses which are curved in a concave direction upwardly and away from the central axis.

25. Apparatus according to claim 24 in which each bed includes recesses as defined in claim 24.

26. Exercise apparatus comprising:

first and second elongated and substantially rigid beds disposed so an end of one of the beds is adjacent an end of the other bed;

means for supporting the beds so they can pivot with respect to each other about a substantially horizontal central axis between adjacent ends of the beds and extending transverse to the beds; and telescoping means mounted on the two beds for releasably locking them in a substantially flat plane.

* * * * *